US007558500B2

(12) United States Patent
Shibata

(10) Patent No.: US 7,558,500 B2
(45) Date of Patent: Jul. 7, 2009

(54) IMAGE FORMING DEVICE HAVING DIVISION COUNTERS ASSOCIATED WITH EACH DIVISION AND AN UNDEFINED COUNTER WHICH IS NOT ASSOCIATED WITH THE DIVISION

(75) Inventor: Kyoichi Shibata, Mishima (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 443 days.

(21) Appl. No.: 11/427,229

(22) Filed: Jun. 28, 2006

(65) Prior Publication Data

US 2007/0002370 A1 Jan. 4, 2007

(30) Foreign Application Priority Data

Jun. 30, 2005 (JP) ..... 2005-191963

(51) Int. Cl.
*G03G 21/02* (2006.01)

(52) U.S. Cl. ..... 399/79

(58) Field of Classification Search ..... 399/79, 399/80, 82

See application file for complete search history.

(56) References Cited

U.S. PATENT DOCUMENTS 5,223,894 A * 6/1993 Ito ..... 399/79
5,300,761 A * 4/1994 Kasahara et al. ..... 399/79
5,903,801 A * 5/1999 Nakamura ..... 399/79
6,178,298 B1 * 1/2001 Nagatani ..... 399/79
7,340,194 B2 * 3/2008 Ozawa ..... 399/79

FOREIGN PATENT DOCUMENTS

JP 2004-252709 9/2004
JP 2004-282274 10/2004
JP 2004-318225 11/2004

* cited by examiner

*Primary Examiner*—William J Royer
(74) *Attorney, Agent, or Firm*—SoCal IP Law Group LLP; Steven C. Sereboff; M. Kala Sarvaiya

(57) ABSTRACT

In an image forming device, a plurality of division counters associated with each division to which each user belongs, and an undefined counter which is not associated with the division are set in an internal memory. In a case where a request for printing an image is accepted, it is judged whether or not the image to be printed includes a page to be chromatically printed. In a case where the page to be chromatically printed is included, the image forming device identifies the division which has requested the printing, the number of the pages to be chromatically printed is counted in the division counter corresponding to the division which has requested the printing, and the number of pages to be monochromatically printed is counted in the division undefined counter.

18 Claims, 3 Drawing Sheets

IMAGE FORMING DEVICE HAVING DIVISION COUNTERS ASSOCIATED WITH EACH DIVISION AND AN UNDEFINED COUNTER WHICH IS NOT ASSOCIATED WITH THE DIVISION

CROSS-REFERENCE TO RELATED APPLICATIONS

This application is based upon and claims the benefit of priority from prior Japanese Patent Application No. 2005-191963, filed Jun. 30, 2005, the entire contents of which are incorporated herein by reference.

BACKGROUND OF THE INVENTION

1. Field of the Invention

The present invention relates to an image forming device such as a digital multifunction machine having a division management function which manages use results such as the number of pages printed for each division, and a method of managing the image forming device.

2. Description of the Related Art

Heretofore, among image forming devices such as a digital multifunction machine, there is a device having a function which manages the number of printed pages. In an image forming device such as the digital multifunction machine or a printer having a network communication function, there is assumed an operation mode in which the device is utilized by a large number of users. Among such image forming devices, there is a device having a function referred to as a division management function which manages the number of pages printed by each management unit referred to as a division. In this division management function, a division counter set in each division counts the number of the pages printed by each division.

BRIEF SUMMARY OF THE INVENTION

In one aspect of this invention, an object is to provide an image forming device capable of appropriately managing use results in accordance with user's request, and a method of managing the image forming device.

An image forming device as one aspect of this invention has: an image forming unit having a first operation mode to form an image on an image forming medium and a second operation mode to form an image on the image forming medium, the first operation mode being different from the second operation mode; a plurality of first counters which are associated with each division to which each user belongs; a second counter which is not associated with any specific division; a first counting unit to count the number of the pages having the images formed thereon in the first operation mode in the image forming unit, by use of the first counter corresponding to the division to which the user belongs who has requested image forming; and a second counting unit to count the number of the pages having the images formed thereon in the second operation mode in the image forming unit, by use of the second counter.

A method of managing an image forming device, as another aspect of this invention, accepts, from a user, a request for image forming in a first operation mode or a request for image forming in a second operation mode which is different from the first operation mode, counts the number of pages having images formed thereon in the first operation mode as a first counter value associated with a division to which the user belongs who has requested the image forming, and counts the number of pages having images formed thereon in the second operation mode as a second counter value which is not associated with a specific division.

An image forming device as still another aspect of this invention has: image forming means for having a first operation mode to form an image on an image forming medium and a second operation mode to form an image on the image forming medium, the first operation mode being different from the second operation mode; a plurality of first counters which are associated with each division to which each user belongs; a second counter which is not associated with any specific division; first counting means for counting the number of the pages having the images formed thereon in the first operation mode in the image forming means, by use of the first counter corresponding to the division to which the user belongs who has requested image forming; and second counting means for counting the number of the pages having the images formed thereon in the second operation mode in the image forming means, by use of the second counter.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

There will be described hereinafter an embodiment for carrying out this invention with reference to the drawings.

Figure 1:
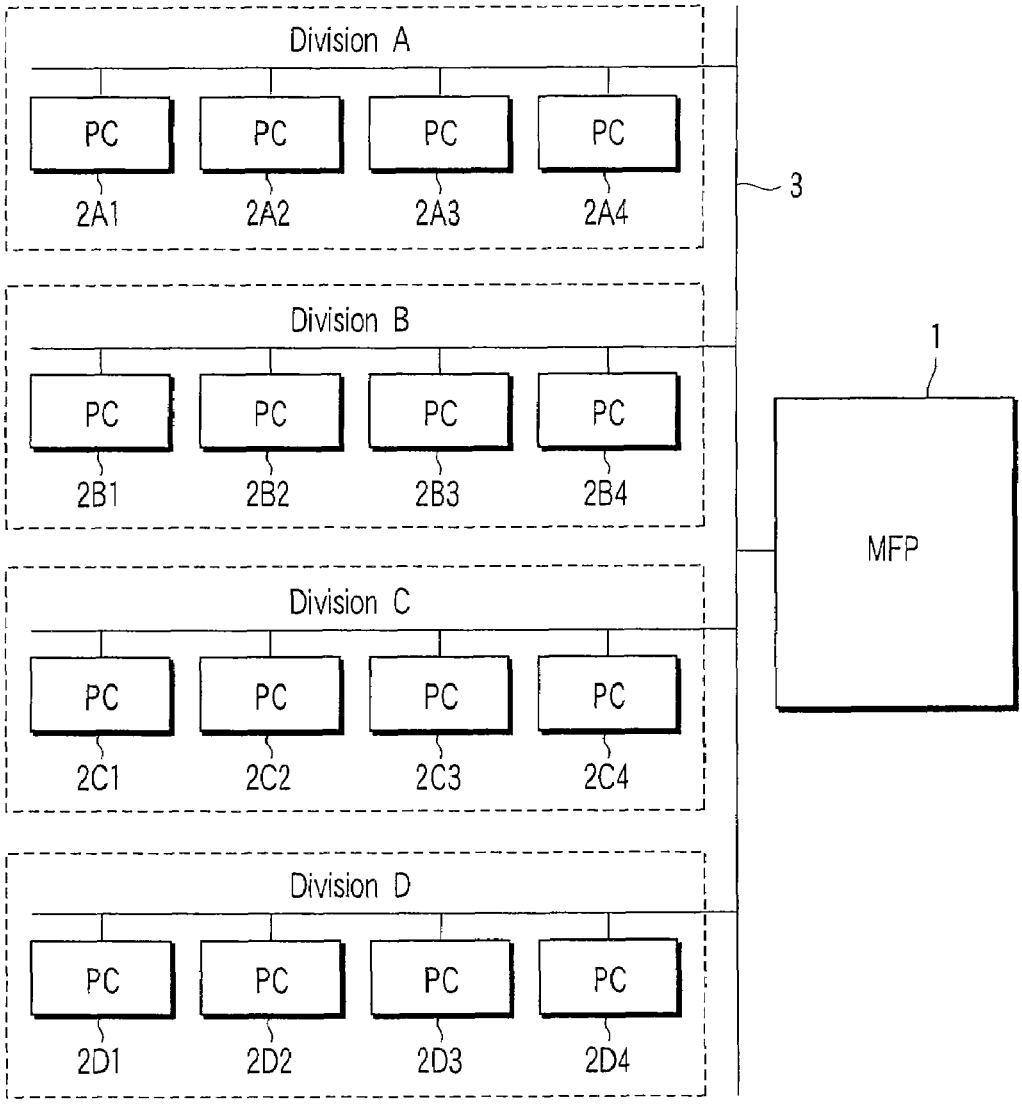
FIG. 1 is a diagram schematically showing a constitution example of an image forming system in an embodiment of the present invention.

FIG. 1 is a diagram showing a schematic constitution of an image forming system in the embodiment of this invention.

As shown in FIG. 1, in this image forming system, a digital multifunction machine (multifunction peripheral [MFP] ) 1 as an image forming device is connected to a plurality of personal computers (PCs) 2 (2A1 to 2A4, 2B1 to 2B4, 2C1 to 2C4 and 2D1 to 2D4) by a network 3 such as a local area network (LAN).

The MFP 1 mainly has a printer function, a scanner function, a photocopying function and the like. The MFP 1 has a function which processes a color image and a function which processes a monochromatic image.

That is, the MFP 1 has: a color scanning function which chromatically reads an image of a draft; a monochromatic scanning function which monochromatically reads the image of the draft; a color printing function which forms a color image on an image forming medium; and a monochromatic printing function which forms a monochromatic image on the image forming medium. Accordingly, the MFP 1 realizes color photocopy and monochromatic photocopy as the photocopying function, and realizes color print and monochromatic print as the printer (network print) function.

Each PC 2 is constituted of a main body having a network interface (not shown), a display unit (not shown), an operation unit (not shown) and the like. The PC 2 has a function which requests the MFP 1 to print the image via the network 3. In the function which requests the MFP 1 to print the image, each PC 2 transmits color image data or monochromatic image data as printing image data. For example, when the PC 2 requests the MFP 1 to print the color image data, the peripheral performs the color print based on the color image data received by a network printing function. When the MFP 1 is requested to print the monochromatic image data, from the PC 2, the peripheral performs the monochromatic print based on the monochromatic image data received by the network printing function.

Moreover, it is assumed that the PCs 2 (2A1 to 2A4, 2B1 to 2B4, 2C1 to 2C4 and 2D1 to 2D4) are assigned to the users divided into groups referred to as divisions, respectively. Here, the division refers to the group to which each user having each PC 2 assigned thereto belongs. In an organization such as a company, it is assumed that a department, a section or the like as a place to which each of a plurality of users belongs corresponds to the division.

In a constitution example shown in FIG. 1, it is indicated that a plurality of PCs 2A1 to 2A4 are used by the users who belong to a division A. In FIG. 1, it is also indicated that a plurality of PCs 2B1 to 2B4 are used by the users who belong to a division B. It is further indicated in FIG. 1 that a plurality of PCs 2Cl to 2C4 are used by the users who belong to a division C. It is further indicated in FIG. 1 that a plurality of PCs 2D1 to 2D4 are used by the users who belong to a division D.

Next, there will be described a constitution of a control system of the MFP 1.

Figure 2:
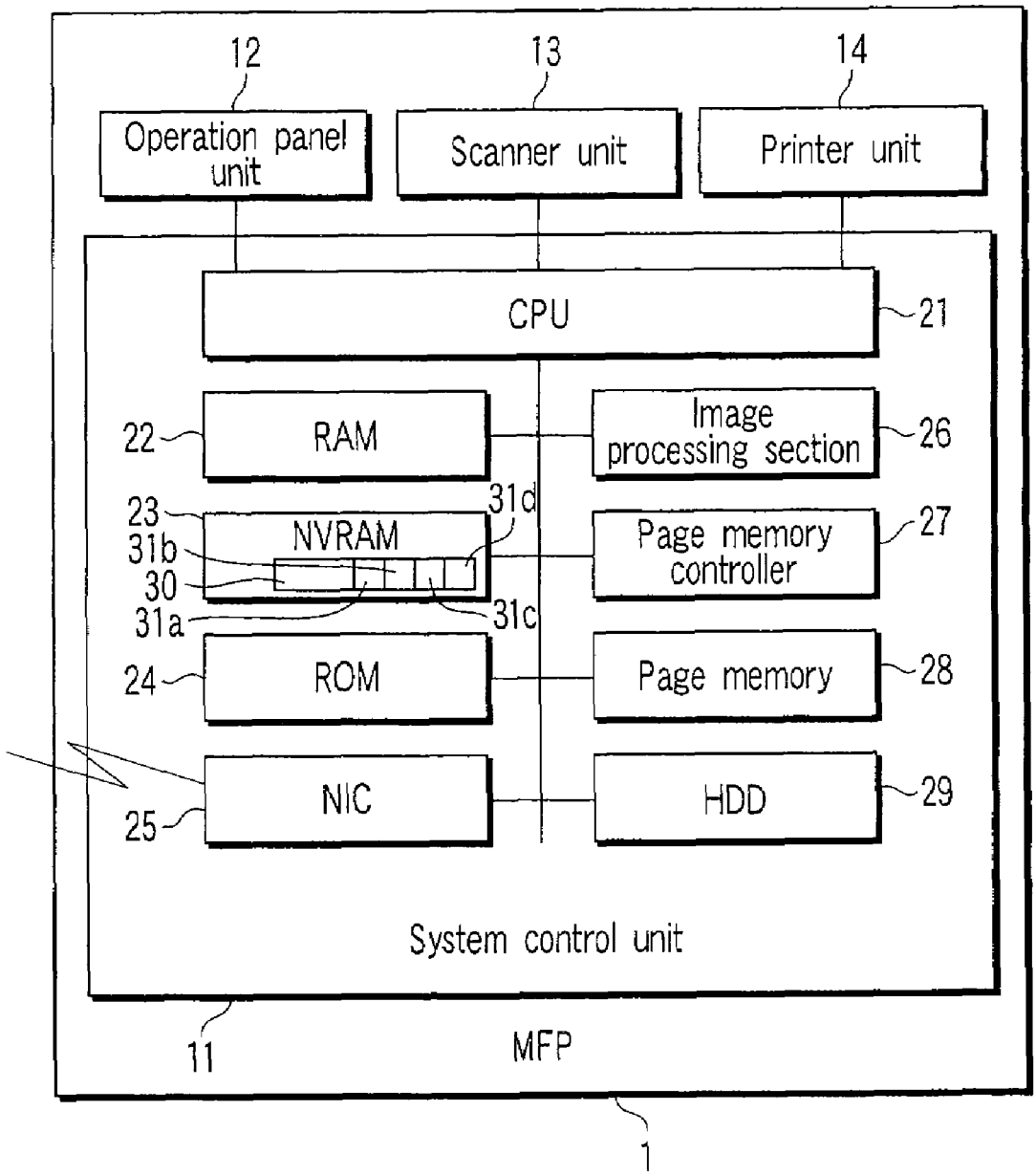
FIG. 2 is a block diagram schematically showing a constitution example of a digital multifunction machine.

FIG. 2 is a block diagram showing a constitution example of the control system of the MFP 1.

As shown in FIG. 2, this MFP 1 is constituted of a system control unit 11, an operation panel unit 12, a scanner unit 13, a printer unit 14 and the like.

The system control unit 11 controls the whole MFP 1. The system control unit 11 is connected to the operation panel unit 12, the scanner unit 13, the printer unit 14 and the like. Accordingly, the system control unit 11 accepts an operation instruction input into the operation panel unit 12, controls the scanner unit 13, or controls the printer unit 14. In addition to the function which controls the scanner unit 13 and the printer unit 14, the system control unit 11 also has a function which performs various types of processing such as network communication control, division (or user) authentication, data management, image judgment and image correction.

The operation panel unit 12 is a user interface. The operation panel unit 12 is constituted of hardware keys (not shown), a display device (not shown) containing a touch panel and the like. The operation panel unit 12 displays an operation guidance and the like, and an operation instruction is input. Settings of various types of functions, setting information and the like are input by the operation panel unit 12.

The scanner unit 13 converts a draft image into image data. The scanner unit 13 converts the draft image into chromatic or monochromatic digital image data. The scanner unit 13 is constituted of: a scanning unit (not shown) which optically scans a draft face; a photoelectric converting section (not shown) such as a CCD line sensor which converts, into an electric signal, reflected light from the draft face optically scanned by the scanning section and the like. The scanner unit 13 supplies the digital image data as the read draft image to the system control unit 11.

The printer unit 14 forms the image on the image forming medium. The printer unit 14 has a color printing function which forms a color image on the image forming medium based on the color image data, and a monochromatic printing function which forms a monochromatic image on the image forming medium based on the monochromatic image data. The printer unit 14 is constituted of: a conveying section (not shown) which conveys the image forming medium, an image forming section (not shown) which forms a color image or a monochromatic image on the image forming medium conveyed by the conveying section and the like. The printer unit 14 prints the image data of each page on the image forming medium based on the control performed by the system control unit 11.

Moreover, as shown in FIG 2, the system control unit 11 is constituted of: a central processing unit (CPU) 21; a random access memory (RAM) 22; an NVRAM 23; a read only memory (ROM) 24; a network communication section (NIC) 25; an image processing section 26; a page memory controller 27; a page memory 28; a hard disk drive (HDD) 29 and the like.

The CPU 21 controls the whole system control unit 11. The CPU 21 operates based on a control program to perform various types of processing. The CPU 21 is connected to the operation panel unit 12, the scanner unit 13, the printer unit 14 and the like. The RAM 22 is a memory which temporarily stores data for an operation and the like. For example, the RAM 22 is loaded with the control program to be executed by the CPU 21, or temporarily stores data being processed or transmission and reception data.

The NVRAM 23 is a rewritable nonvolatile memory. In the NVRAM 23, setting data, management data and the like are stored. Further in the NVRAM 23, there is stored division management information such as a division code corresponding to a division as a management object of a division management function described later. Furthermore, the NVRAM 23 includes: a division undefined counter 30 in which the corresponding division is not defined; a division counter 31 (31*a* to 31*d*) for each division as the management object of the division management function and the like. It is to be noted that the division undefined counter 30 and the division counter 31 will be described later in detail.

The ROM 24 is a nonvolatile memory. In the ROM 24, there are stored, for example, the control program, control data and the like for controlling the MFP 1. The network communication section 25 controls data communication via the network 3. The network communication section 25 is constituted of a network interface card (NIC) to be connected to the network 3 and the like. In the network communication section 25, a network printer function receives a request for printing the printing image data and the like from each PC 2 via the network 3.

The image processing section 26 subjects the image data to various types of image processing. The image processing section 26 is constituted of an image processing circuit and the like. The image processing section 26 performs image processing such as correction, compression or extension of the image data.

The page memory controller 27 controls the page memory 28.

The page memory 28 is a memory having at least a storage region to develop the image data for one page to be printed by the printer unit 14. In a case where the printer unit 14 performs the print processing, in the page memory 28, there is developed (stored) the color image data or the monochromatic image data of each page to be printed by the printer unit 14.

The HDD 29 is a large-capacity storage device. In this HDD 29, there is stored, for example, data received via the network 3, the image data read by the scanner unit 13 or the like, if necessary.

Moreover, as described above, the NVRAM 23 is provided with the division undefined counter 30 and the division counter 31 (31*a*, 31*b*, 31*c* and 31*d*). The division undefined counter 30 is a counter which is not associated with a specific division. The division counters 31*a*, 31*b*, 31*c* and 31*d* are counters associated with the divisions as the management objects, respectively, by the division management function.

It is to be noted that in the constitution example shown in FIG. 2, there is assumed a case where, as shown in FIG. 1, the divisions A, B, C and D are set as the divisions constituting the management objects of the MFP 1. Therefore, in the MFP 1, the divisions A, B, C and D are set as the management objects of the division management function described later.

In this case, in the NVRAM 23, there are stored division management information such as division codes corresponding to the divisions A, B, C and D, and there are arranged the division counters 31*a*, 31*b*, 31*c* and 31*d* associated with the divisions A, B, C and D as the divisions constituting the management objects. That is, the division counter 31 is set for each division constituting the management object of the division management function of the MFP 1.

Next, there will be described the color print and the monochromatic print in the MFP 1 constituted as described above.

Here, it is assumed that the MFP 1 manages various types of processing such as a series of photocopy processing, scanner processing and print processing every unit referred to as a job.

For example, the photocopy processing executed in accordance with one instruction is managed as a photocopying job. The photocopy processing includes: scan processing to read a draft image; and print processing to print the image read by the scan processing. Therefore, the photocopying job may be managed by a scanning job and a printing job.

Furthermore, in the network printing function, the print processing for one printing request is managed as a printing job. The printing job manages a series of print processing. Therefore, one printing job prints the image for one page in some case, and prints the image for a plurality of pages in the other case.

In addition, the MFP 1 has a monochromatic photocopy mode, a color (full color) photocopy mode, and an auto color mode as the above photocopying function. The monochromatic photocopy mode is a mode to read the draft image as the monochromatic image, and monochromatically print the read monochromatic image on the image forming medium. The color photocopy mode is a mode to read the draft image as the color image, and chromatically print the read color image on the image forming medium.

Moreover, in the auto color mode, it is judged whether or not the draft image is chromatic or monochromatic, and color photocopy (color scan and color print) or monochromatic photocopy (color scan and monochromatic print) is executed in accordance with the judgment result. Therefore, in the auto color mode, color photocopy and memory photocopy are mixed in one photocopy processing (one photocopying job). In such case, the MFP 1 has to judge whether the photocopy is the color photocopy or the monochromatic photocopy for each page.

On the other hand, the MFP 1 selectively executes, as the network printing function, the color print or the monochromatic print in accordance with the printing image data supplied together with the printing request from each PC 2.

In this case, in the MFP 1, the color print or the monochromatic print is not identified in some case at a time when the printing request from the PC 2 is received. There is also a case where the color print and monochromatic print are mixed in one print processing (one printing job). In such case, the MFP 1 has to judge whether or not the print is chromatic or monochromatic for each page.

For example, it is assumed that various applications are installed in each PC 2. Even in a case where a printer driver corresponding to the MFP 1 is installed in the PC 2, the printing image data is sometimes sent to the MFP 1, not via the printer driver, in accordance with the application being executed by the PC 2.

In such case, the MFP 1 cannot judge whether the image data of each page is the color image data (i.e., whether or not to execute the color print) or the monochromatic image data (i.e., whether or not to execute the monochromatic print), unless the printing image data of each page is developed in a page memory.

As described above, in the photocopying functions or the network printing function of the MFP 1, in some case, unless it is checked whether the printing image data of each page is the color image data or the monochromatic image data, it cannot be judged whether or not to execute the color print or the monochromatic print.

Next, there will be described the division management function of the MFP 1.

The division management function of the MFP 1 is a function which manages use results (the number of printed pages, etc.) of the MFP 1 for each division. For example, in the image forming system shown in FIG. 1, the division management function of the MFP 1 manages the number of the pages printed for each division or limits the number of printable pages for each division. It is to be noted that the division management function is set to be valid or invalid by an operation of the operation panel unit 12.

Moreover, information (division management information such as the division code) on the division as the management object of the division management function is set beforehand by the operation panel unit 12 or the like, and stored in the NVRAM 23 or the like. That is, the division managed by the division management function is set beforehand in accordance with the division code for identifying the division. It is to be noted that in a case where an upper limit of the number of color print pages is set for each division, the upper limit of the number of the color print pages in the corresponding division is also stored in the NVRAM 23.

For example, in the image forming system shown in FIG. 1, the divisions constituting the management objects are the divisions A, B, C and D. In this case, unique division codes are set to the divisions (divisions A, B, C and D), respectively. In a case where the thus set division management function is valid, the MFP 1 identifies the division to which the user belongs based on the division code designated by the user.

For example, in a case where the photocopying function is utilized in a state in which the division management function is valid, the user inputs the division code by the operation panel unit 12 of the MFP 1. When the user inputs the division code by the operation panel unit 12, the MFP 1 authenticates the user's division based on the division code input by the user and the division code as the division management information set beforehand. Accordingly, when the user s division is identified, the MFP 1 is brought into a state in which the photocopying is possible in response to the user's operation. When the user operates the operation panel unit 12 to request desired photocopy, the MFP 1 executes the requested photocopy processing, and manages the number of the printed photocopy pages as the use result of the identified division.

Moreover, in a case where the network printing function is utilized in a state in which the division management function is valid, the user designates, by each PC 2, the printing image data and the division code of the division to which the user belongs. In this case, the PC 2 transmits a printing request including the printing image data and the division code to the MFP 1 via the network 3. On receiving the printing request from the PC 2 via the network 3, the MFP 1 authenticates the user's division based on the division code included in the received printing request and the division code as the division management information set beforehand. Accordingly, when the user's division is identified, the MFP 1 executes the print processing based on the received printing image data, and manages the number of the pages printed in the print processing as the use results of the identified division.

Next, there will be described management of the number of the printed pages by the division management function.

The MFP 1 has a color managing (management for color only) function which manages only the number of chromatically printed pages for each division in the division management function. In other words, this color management function is a function (function which does not manage the monochromatic print for each division) which does not count the number of monochromatically printed pages, by use of a division counter. In the MFP 1 having a state in which this color management function is valid, the monochromatic print is limitlessly performed without identifying any division or without any restriction on the upper limit of the number of the pages.

In general, in the monochromatic print, consumption of a developer such as toner, a photosensitive member or the like is small, and cost is small as compared with the color print. The monochromatic print is utilized in performing miscellaneous daily printings in many cases. In a case where any restriction is not imposed on the monochromatic print, and the color print only is managed in such situation, the above color management function is required. According to the color management function, the monochromatic print can limitlessly be performed, and it is possible to manage only the use result of the color print.

It is to be noted that the present embodiment will be described on presumptions that the color print is managed for each division, and the monochromatic print is judged to be other than the management object for each division in a state in which the division management function is valid.

Next, there will be described processing performed by the MFP 1 in a state in which the division management function and the color management function are valid.

Figure 3:
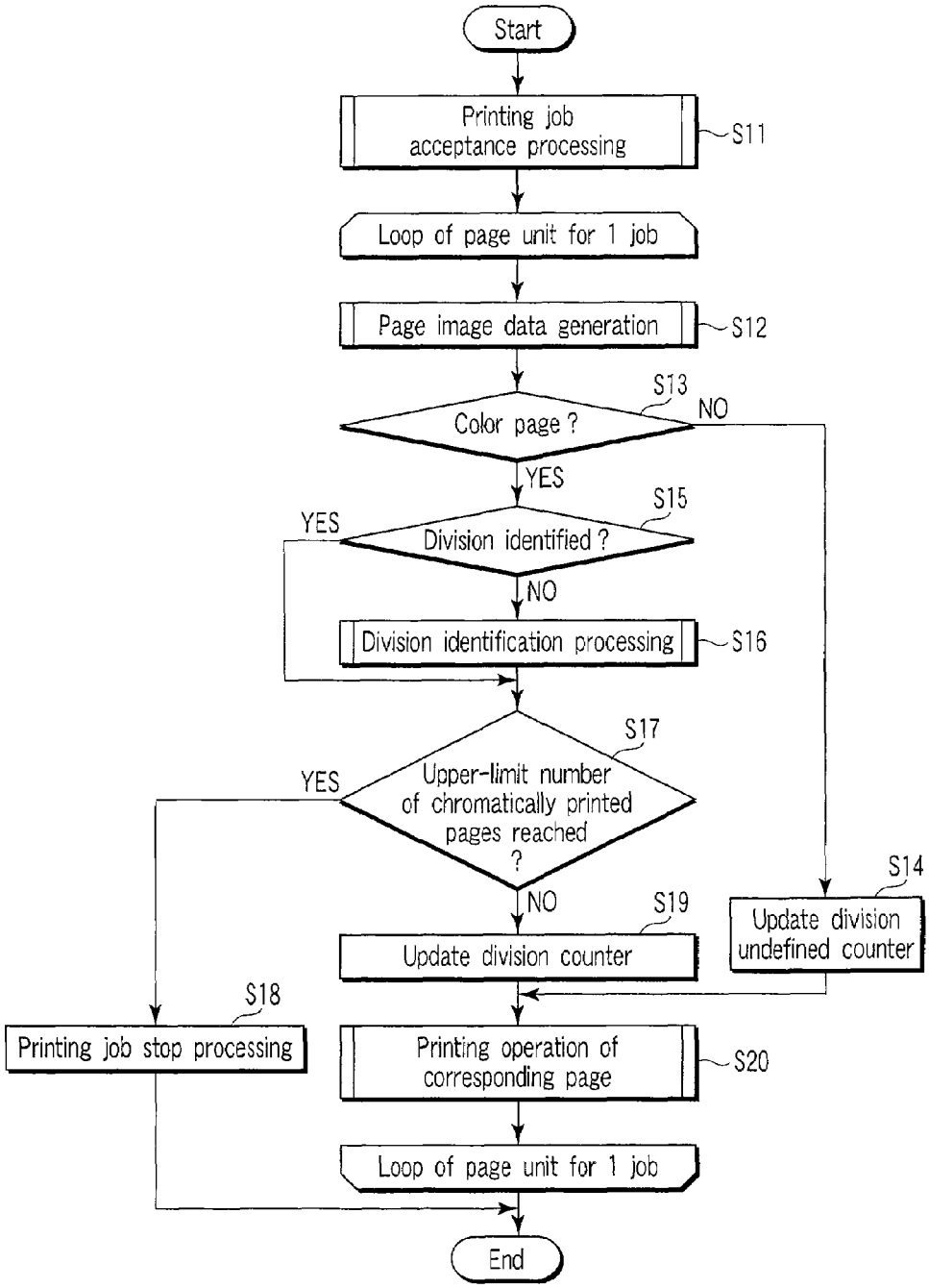
FIG. 3 is a flowchart showing count processing in print processing of the digital multifunction machine.

FIG. 3 is a flowchart showing processing to count the number of pages to be printed by the MFP 1 in a state in which the division management function and the color management function are valid.

For example, in the MFP 1, in a case where the printing request is received as the network printing function from the PC 2, or the draft image is read by a scanner as the photocopy function, one printing job is generated. When such printing job is generated, in the MFP 1, the CPU 21 of the system control unit 11 performs processing to accept the corresponding printing job (step S11).

The above printing job acceptance processing manages the printing job as a job, and temporarily accumulates data of the printing job in the RAM 22 or the HDD 29 as a main memory. It is to be noted that the above data of one printing job includes data of all pages (one page or a plurality of pages) to be printed as the printing job.

Moreover, the printer unit 14 performs the print processing based on the image data stored in the page memory 28. Therefore, the CPU 21 of the system control unit 11 successively generates the image data of each page from the printing job data accumulated in the main memory (RAM 22 or HDD 29) every time each page is printed. Each generated page image data is developed as the printing image data in the page memory 28.

For example, there will be described processing to accept the printing job by the network printing function of the MFP 1 in the image forming system.

In a case where the network printing function of the MFP 1 is utilized in the image forming system, the user designates the image to be printed and the division code by the PC 2. Then, the PC 2 transmits the printing request to the MFP 1 via the network 3. The printing request includes the data of the image to be printed and the division code.

Such printing request is received by the network communication section 25 in the system control unit 11 of the MFP 1. On receiving the printing request, the system control unit 11 of the MFP 1 accumulates the received printing request data in the RAM 22 or the HDD 29 as the main memory, and accepts the printing request as one printing job.

On receiving the printing job by the above processing, the CPU 21 of the system control unit 11 executes the print processing of each page of the accepted printing job (steps S12 to S20).

That is, in a case where one printing job is executed, the CPU 21 successively extracts each page data from the printing job data stored in the main memory, and generates image data of each page (step S12).

In the processing to generate the image data of each page, the data of the page is read out from the data of the printing job accumulated in the main memory, and the read page data is developed in the page memory 28 by raster image processing (RIP). Accordingly, in the page memory 28, there is stored the image data of the page to be printed by the printer unit 14.

When the image data of the page to be printed is developed in the page memory 28, the CPU 21 of the system control unit 11 judges whether the page image data be chromatically or monochromatically printed (step S13). This judgment processing is performed by judgment in accordance with a data form of the image data developed in the page memory 28.

That is, the judgment processing is performed by judging whether the image data developed in the page memory 28 is chromatic or monochromatic image data. For example, in a case where the image data developed in the page memory 28 is the color image data, the CPU 21 judges that the page is to be printed in a color printing mode. In a case where the image data developed in the page memory 28 is the monochromatic image data, the CPU 21 judges that the page is to be printed in a monochromatic printing mode.

However, in a case where the color print or the monochromatic print is designated as the printing mode of the printing job. In the above judgment processing, the color print or the monochromatic print is judged in accordance with the designated printing mode. That is, in a case where the color printing mode of the printing job is designated, the judgment processing judges that all pages be chromatically printed. In a case where the monochromatic printing mode of the printing job is designated, the judgment processing judges that all the pages be monochromatically printed.

In the following description, there is presumed a case where the color print or the monochromatic print is not designated with respect to each page to be printed in one printing job. That is, there is presumed a case where one printing job is a printing job generated by the photocopy processing in which the auto color mode is designated in the photocopying function or a printing job generated in response to the printing request without designating the color print or the monochromatic print in the network printing function.

In a case where the judgment processing judges that the image data developed in the page memory 28 is to be printed in the monochromatic printing mode (step S13, NO), the CPU 21 counts up a counter value of the division undefined counter 30 (step S14). In other words, in a case where it is judged that the page developed in the page memory 28 is to be monochromatically printed, the CPU 21 counts the number of the monochromatically printed pages by the division undefined counter 30 which is not associated with the specific division.

Moreover, in a case where it is judged by the above judgment processing that the image data developed in the page memory 28 is to be printed in the color printing mode (step S13, YES), the CPU 21 judges whether or not the division which has requested the printing job is determined (step S15). In other words, the CPU 21 judges whether or not there is selected the division counter 31 to count the number of the chromatically printed pages in the printing job.

In a case where the above judgment is that the division which has requested the printing job is not determined (step S15, NO), the CPU 21 performs division identification (division authentication) processing to determine the division which has requested the printing job (step S16). This division identification processing is performed based on, for example, the division code input by the user who has requested the printing job and the division code set beforehand.

For example, in the above network printing function, the division code is designated by the PC 2, and transmitted together with the printing request. Therefore, during the network printing, the division which has requested the printing job is identified based on the division code included in the printing request from the PC 2 and the division code of the division constituting the management object of the division management function set beforehand. It is to be noted that in a case where the division code is not transmitted together with the printing request, the MEP 1 may request the PC 2 to input the division code, or stop the printing job.

Moreover, in the photocopying function of the auto color mode, the division which has requested the printing job is identified based on the division code input by the operation panel unit 12 by the user and the preset division code of the division as the management object of the division management function of the MFP 1. It is to be noted that in the photocopy processing of the auto color mode, as the division management function of the MFP 1, there are considered a case where the input of the division code is requested together with a photocopy instruction and a case where the input of the division code is requested as required (a case where the input of the division code is not requested together with the photocopy instruction).

For example, in a case where the input of the division code is requested together with the photocopy instruction, the user operates the operation panel unit 12 to instruct the photocopy and input the division code. In this case, the CPU 21 may perform division identification processing at a time when the division code is designated (the photocopy is instructed).

Moreover, in a case where the input of the division code is requested if necessary, the user does not input the division code together with the photocopy instruction in some case. In such situation, in a case where the division needs to be identified, that is, a need for the color print is generated, the CPU 21 displays a guidance to urge the user to input the division code in a display unit of the operation panel unit 12, and accepts the input of the division code from the user. In this case, the CPU 21 may allow the user to identify the division by the input division code and the preset division code in the operation panel unit 12.

In a case where the above judgment is that the division which has requested the printing job is determined (step S15, YES) or a case where the division identification processing determines the division (step S16), the CPU 21 judges whether or not the counter value of the division counter corresponding to the division reaches the upper limit of the number of the pages to be chromatically printed, the upper limit being set beforehand with respect to the division (step S17). It is to be noted that in a case where the upper limit of the number of the pages to be chromatically printed is not set, the above step S17 is omitted.

In a case where the judgment is that the counter value of the division counter corresponding to the division reaches the upper limit of the number of the pages to be chromatically printed, preset with respect to the division (step S17, YES), the CPU 21 stops the printing job (step S 18). In the processing to stop this printing job, the CPU 21 may stop the printing job, and notify the user that the printing has been stopped because the value has reached the upper limit of the number of the pages to be chromatically printed for the division.

Moreover, in a case where the judgment is that the counter value of the division counter corresponding to the division does not reach the upper limit of the number of the pages to be chromatically printed, preset with respect to the division (step S17, NO), the CPU 21 counts up as much as one value in the division counter 31 corresponding to the division (step S19). In other words, in a case where it is judged that the page developed in the page memory 28 be chromatically printed, the CPU 21 counts the number of the chromatically printed pages by the division counter 31. corresponding to the division which has requested the printing job.

When the division undefined counter 30 or the division counter 31 is counted up, the CPU 21 prints, by the printer unit 14, the image of the page developed in the page memory 28 (step S20). In this print processing, the image data developed in the page memory 28 is printed in the printing mode in the printer unit 14 in the step S13.

The above processing of the steps S12 to S20 is executed with respect to all of the pages in the printing job. Accordingly, each page of the printing job is printed in the color printing mode or the monochromatic printing mode. As a result of the execution of the printing job, the number of the chromatically printed pages is counted in the division counter 31, and the number of the monochromatically printed pages is counted in the division undefined counter 30.

As described above, in the present embodiment, the division counter for each division and the division undefined counter are set beforehand. In a case where there is accepted the request for printing, when there exists the page to be chromatically printed, the division which has requested the printing is identified, the number of the pages to be chromatically printed is counted in the division counter corresponding to the division which has requested the printing, and the number of the pages to be monochromatically printed is counted in the division undefined counter. Accordingly, only the number of the chromatically printed pages can be counted for each division, and the number of the pages printed in response to the user's request can be managed.

Moreover, even the monochromatically printed pages are counted in the division undefined counter. Therefore, in the MFP 1, it is possible to manage the number of the chromatically printed pages for each division, and it is also possible to manage the total number of the monochromatically printed pages. As a result, the counter value for use in maintenance of the MFP 1 can normally be counted.

Furthermore, in a case where each page to be printed is developed in the page memory, it is judged whether each page is to be chromatically or monochromatically printed. Therefore, even in a case where the color print and the monochromatic print are mixed in one printing job, it is possible to manage the number of the pages printed in response to user's request without impairing user's convenience.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general invention concept as defined by the appended claims and their equivalents.

What is claimed is:

1. An image forming device comprising:

an image forming unit having a first operation mode to form an image on an image forming medium and a second operation mode to form an image on the image forming medium, the first operation mode being different from the second operation mode;

a plurality of first counters which are associated with each division to which each user belongs;

a second counter which is not associated with any specific division;

a first counting unit to count the number of the pages having the images formed thereon in the first operation mode in the image forming unit, by use of the first counter corresponding to the division to which the user belongs who has requested image forming; and a second counting unit to count the number of the pages having the images formed thereon in the second operation mode in the image forming unit, by use of the second counter.

2. The image forming device according to claim 1, wherein the first operation mode is a color mode in which a color image is formed on the image forming medium, and the second operation mode is a monochromatic mode in which a monochromatic image is formed on the image forming medium.

3. The image forming device according to claim 2, further comprising:

a judgment unit which judges whether the image is to be formed in the color mode or the monochromatic mode for each page, the first counting unit counting up the first counter corresponding to the division to which the user belongs who has requested the image forming, in a case where the judgment unit judges that the image for one page is to be formed in the color mode, the second counting unit counting up the second counter, in a case where the judgment unit judges that the image for one page is to be formed in the monochromatic mode.

4. The image forming device according to claim 3, further comprising:

a main memory which accumulates data of the image forming; and a page memory to store image data for one page which is successively generated from the data of the image forming accumulated in the main memory and which is used to form the image in the image forming unit, the judgment unit judging whether the image of the page is to be formed in the color mode or the monochromatic mode, in a case where the image data for one page to form the image is stored in the page memory.

5. The image forming device according to claim 1, further comprising:

a control unit which prohibits the image forming in the first operation mode in response to the request from the user who belongs to the division corresponding to the first counter, in a case where a value of the first counter counted in the first counting unit reaches a predetermined threshold value.

6. The image forming device according to claim 3, further comprising:

a control unit which prohibits the image forming in the color mode in response to the request from the user who belongs to the division corresponding to the first counter, in a case where a value of the first counter counted up by the first counting unit reaches a predetermined threshold value.

7. A method of managing an image forming device, comprising:

accepting, from a user, a request for image forming in a first operation mode or a request for image forming in a second operation mode which is different from the first operation mode;

counting the number of pages having images formed thereon in the first operation mode as a first counter value associated with a division to which the user belongs who has requested the image forming; and counting the number of pages having images formed thereon in the second operation mode as a second counter value which is not associated with a specific division.

8. The method of managing the image forming device according to claim 7, wherein the first operation mode is a color mode in which a color image is formed on an image forming medium, and the second operation mode is a monochromatic mode in which a monochromatic image is formed on the image forming medium.

9. The method of managing the image forming device according to claim 8, further comprising:

judging whether the image is to be formed in the color mode or the monochromatic mode in the accepted image forming for each page, the counting of the first counter value including: counting up a counter value of the division which has requested the image forming, in a case where the judgment is that the image for one page is to be formed in the color mode, the counting of the second counter value including: counting up an undefined counter value, in a case where the judgment is that the image for one page is to be formed in the monochromatic mode.

10. The method of managing the image forming device according to claim 9, further comprising:

accumulating, in a main memory, data of the accepted image forming; and storing, in a page memory, image data for one page which is successively generated from the data of the image forming accumulated in the main memory and which is used to form the image, the judgment including: judging whether the image of the page is to be formed in the color mode or the monochromatic mode, in a case where the image data for one page to form the image is stored in the page memory.

11. The method of managing the image forming device according to claim 7, further comprising:

prohibiting the image forming in the first operation mode in response to the request from the user who belongs to the division corresponding to the first counter, in a case where a value of the first counter reaches a predetermined threshold value.

12. The method of managing the image forming device according to claim 9, further comprising:

prohibiting the image forming in the color mode in response to the request from the user who belongs to the division corresponding to the first counter, in a case where a value of the first counter reaches a predetermined threshold value.

13. An image forming device comprising:

image forming means for having a first operation mode to form an image on an image forming medium and a second operation mode to form an image on the image forming medium, the first operation mode being different from the second operation mode;

a plurality of first counters which are associated with each division to which each user belongs;

a second counter which is not associated with any specific division;

first counting means for counting the number of the pages having the images formed thereon in the first operation mode in the image forming means, by use of the first counter corresponding to the division to which the user belongs who has requested image forming; and second counting means for counting the number of the pages having the images formed thereon in the second operation mode in the image forming means, by use of the second counter.

14. The image forming device according to claim 13, wherein the first operation mode is a color mode in which a color image is formed on the image forming medium, and the second operation mode is a monochromatic mode in which a monochromatic image is formed on the image forming medium.

15. The image forming device according to claim 14, further comprising:

judgment means for judging whether the image is to be formed in the color mode or the monochromatic mode for each page, the first counting means counting up the first counter corresponding to the division to which the user belongs who has requested the image forming, in a case where the judgment means judges that the image for one page is to be formed in the color mode, the second counting means counting up the second counter, in a case where the judgment means judges that the image for one page is to be formed in the monochromatic mode.

16. The image forming device according to claim 15, further comprising:

first memory means for accumulating data of the image forming; and second memory means for storing image data for one page which is successively generated from the data of the image forming accumulated in the first memory means and which is used to form the image in the image forming means, the judgment means judging whether the image of the page is to be formed in the color mode or the monochromatic mode, in a case where the image data for one page to form the image is stored in the second memory means.

17. The image forming device according to claim 13, further comprising:

control means for prohibiting the image forming in the first operation mode in response to the request from the user who belongs to the division corresponding to the first counter, in a case where a value of the first counter counted in the first counting means reaches a predetermined threshold value.

18. The image forming device according to claim 15, further comprising:

control means for prohibiting the image forming in the color mode in response to the request from the user who belongs to the division corresponding to the first counter, in a case where a value of the first counter counted up by the first counting means reaches a predetermined threshold value.

* * * * *